US010968014B2

(12) United States Patent
Mazurek et al.

(10) Patent No.: US 10,968,014 B2
(45) Date of Patent: Apr. 6, 2021

(54) LOCKING PACKAGE

(71) Applicants: Richard A. Mazurek, Huntingdon Valley, PA (US); Patrick McGee, Churchville, PA (US)

(72) Inventors: Richard A. Mazurek, Huntingdon Valley, PA (US); Patrick McGee, Churchville, PA (US)

(73) Assignee: HLP Clear Packaging Products (USA), Inc., Torrance, CA (US)

( * ) Notice: Subject to any disclaimer, the term of this patent is extended or adjusted under 35 U.S.C. 154(b) by 111 days.

(21) Appl. No.: 16/396,079

(22) Filed: Apr. 26, 2019

(65) Prior Publication Data

US 2019/0337689 A1 Nov. 7, 2019

Related U.S. Application Data

(60) Provisional application No. 62/664,149, filed on Apr. 28, 2018.

(51) Int. Cl.
*B65D 5/38* (2006.01)
*B65D 50/04* (2006.01)
*B65D 5/50* (2006.01)

(52) U.S. Cl.
CPC ..... *B65D 50/046* (2013.01); *B65D 5/38* (2013.01); *B65D 5/503* (2013.01)

(58) Field of Classification Search
CPC ..... B65D 5/38; B65D 50/046; B65D 5/503; B65D 2215/02; B65D 2215/04; B65D 50/045; B65D 50/04
USPC ..... 206/1.5, 531, 538
See application file for complete search history.

(56) References Cited

U.S. PATENT DOCUMENTS

| | | | | |
|---|---|---|---|---|
| 7,708,142 | B2 * | 5/2010 | Ehrlund | B65D 5/38 206/528 |
| 7,757,843 | B2 * | 7/2010 | Katsis | A24F 27/00 206/1.5 |
| 9,725,206 | B2 * | 8/2017 | Linssen | B65D 5/38 |
| 2013/0140201 | A1 | 6/2013 | Ghini et al. | |
| 2016/0001937 | A1 | 1/2016 | Skinner | |
| 2017/0217658 | A1 | 8/2017 | Whitehurst | |
| 2018/0022498 | A1 * | 1/2018 | Everett | B65D 5/541 206/1.5 |
| 2018/0105314 | A1 * | 4/2018 | Jones | B65D 5/4266 |

FOREIGN PATENT DOCUMENTS

| | | | |
|---|---|---|---|
| WO | WO2009024772 | A2 | 2/2009 |
| WO | WO2013014462 | A1 | 1/2013 |
| WO | WO2015000896 | A1 | 1/2015 |

* cited by examiner

*Primary Examiner* — Steven A. Reynolds
(74) *Attorney, Agent, or Firm* — Jacobs & Kim LLP; Daniel Kim, Esq.

(57) ABSTRACT

A package includes a tray and a sleeve. The tray is slidable within the inner cavity between a closed position and an open position. A side panel of the sleeve is provided with a rear locking slot. A resiliently deflectable locking tab extends from the tray. The locking tab and rear locking slot are shaped and positioned such that when the tray is seated in its closed position, the tray locking tab extends through the sleeve locking slot, locking the tray into position. Downward deflection of the locking tab causes it to be released from the rear locking slot.

13 Claims, 13 Drawing Sheets

LOCKING PACKAGE

CROSS-REFERENCE TO RELATED APPLICATIONS

The present application claims the priority benefit of the following document:

U.S. Provisional Patent Application Ser. No. 62/664,149, filed on Apr. 28, 2018.

The above application is owned by the assignee of the present application, and is incorporated herein by reference in its entirety.

BACKGROUND OF THE INVENTION

Field of the Invention

The present invention relates generally to the field of product packaging, and in particular to an improved tray-and-sleeve package with a locking structure for releasably holding the tray in a closed position within the sleeve.

Prior Art

The modern product packaging industry is a highly competitive field, in which there is an ongoing effort to create innovative designs that satisfy a number of sometimes conflicting requirements. These requirements include, for example, strength, durability, security, ease of use, and esthetic appeal. In addition, an overarching concern is manufacturing cost. A difference in per-unit cost of only a few cents may make the difference between a successful design and an unsuccessful one.

One feature that may be required in certain applications is the ability to releasably lock a package in a closed configuration. For example, medicine is commonly sold in a package that is child-resistant. Ideally, such a package is virtually impossible for a typical child to open, yet is readily openable and closeable by a typical senior.

A child-resistant package must meet the requirements of applicable law. In the United States, in order to qualify under federal law as "child-resistant" and/or "senior-friendly," a package must be subjected to a rigorous testing process to verify that the package meets the standards set forth in regulations promulgated by the Consumer Product Safety Commission (CPSC), CFR Title 16, Part 1700 standards.

Beyond satisfying regulatory requirements, a successful package design must address other considerations, including esthetic appearance, ease of manufacture, and cost. Another consideration is the efficient use of space. Depending upon a particular application, it may be desirable for a package to be as small as possible. A smaller package means that it is possible to fit more packaged units into a shipping container, storage unit, or retail shelf. A smaller package may be desirable from an esthetic point of view. In addition, a small package typically employs less material, resulting in lower cost and less post-consumer waste.

SUMMARY OF THE INVENTION

An aspect of the invention is directed to a package including a tray and a sleeve. The sleeve has a front panel and a back panel connected by a plurality of side panels so as to form an inner cavity with an insertion opening. The tray is insertable into the insertion opening and is slidable within the inner cavity between a closed position and an open position. The plurality of side panels includes a side panel having a rear locking slot. A resiliently deflectable locking tab extends from the tray. The locking tab and rear locking slot are shaped and positioned such that when the tray is seated in its closed position, the tray locking tab extends through the sleeve locking slot. Contact between a contact edge of the locking tab and a corresponding edge of the rear locking slot prevents movement of the tray out of its closed position towards the insertion opening. The locking tab and the locking slot are further shaped and positioned such that the locking tab is downwardly deflectable to a position in which the contact edge of the locking tab is clear of the corresponding contact edge of the rear locking slot, thereby allowing the tray to be moved out of its closed position. The sleeve is further provided with a resiliently deflectable release tab that is positioned such that, when the tray is in its closed position, the locking tab is releasable from the rear locking slot by downward deflection of the release tab.

Further aspects of the invention are directed to specific details with respect to the respective structures of the locking tab, locking slots, release tabs, and the like.

BRIEF DESCRIPTION OF THE DRAWINGS

The invention will be explained in more detail with reference to the drawings.

DETAILED DESCRIPTION

In order to make the objects, technical solutions and advantages of the present application more clear, the present application will be further described in detail below with reference to the accompanying drawings and embodiments. It should be understood that the specific embodiments described herein are merely illustrative and are not intended to be limiting the present application.

It should be noted that when an element is referred to as being "fixed" or connected to another element, it can be directly fixed on or connected to the other element or the element can be indirectly fixed on or connected to the other element via one or more intermediate elements. Rather, when an element is referred to as being "directly fixed on" or "directly connected to" another element, then there is no intermediate element. The terms "vertical," "horizontal," "left," "right," and the like, as used herein, are for illustrative purposes only.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

Figure 1:
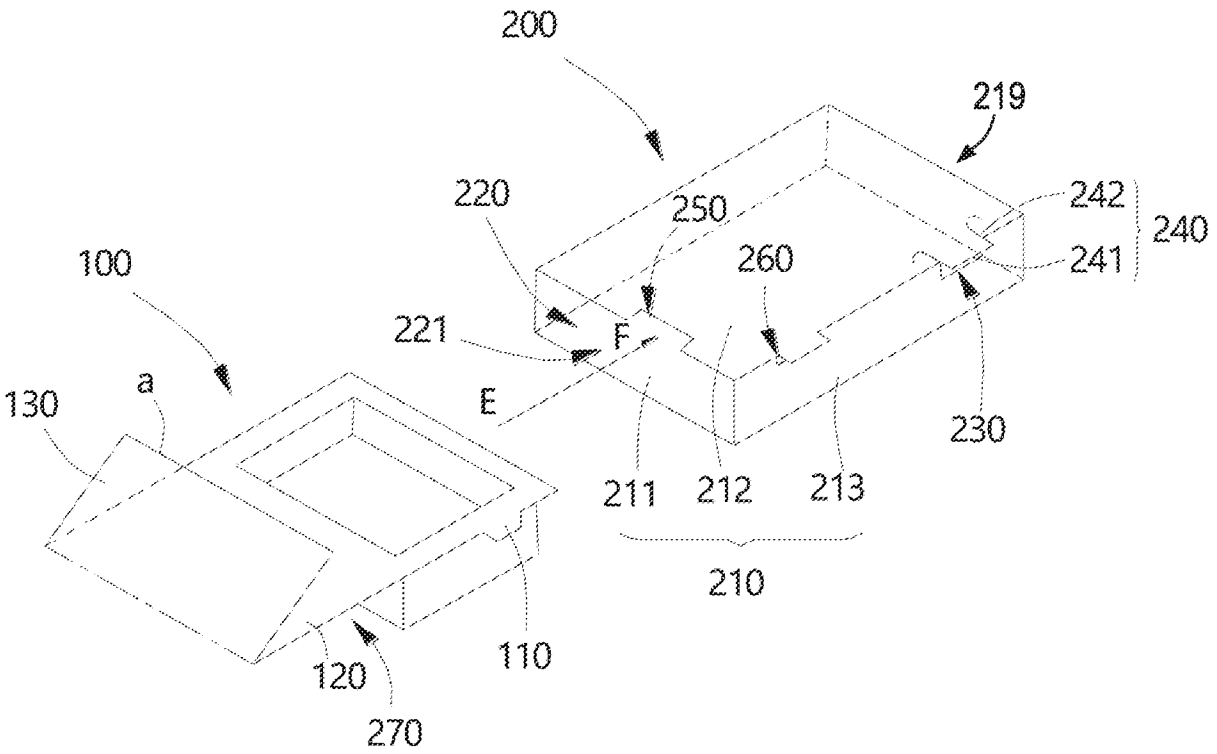
FIG. 1 is an exploded perspective view of a package in accordance with an exemplary practice of the invention.
Figure 2:
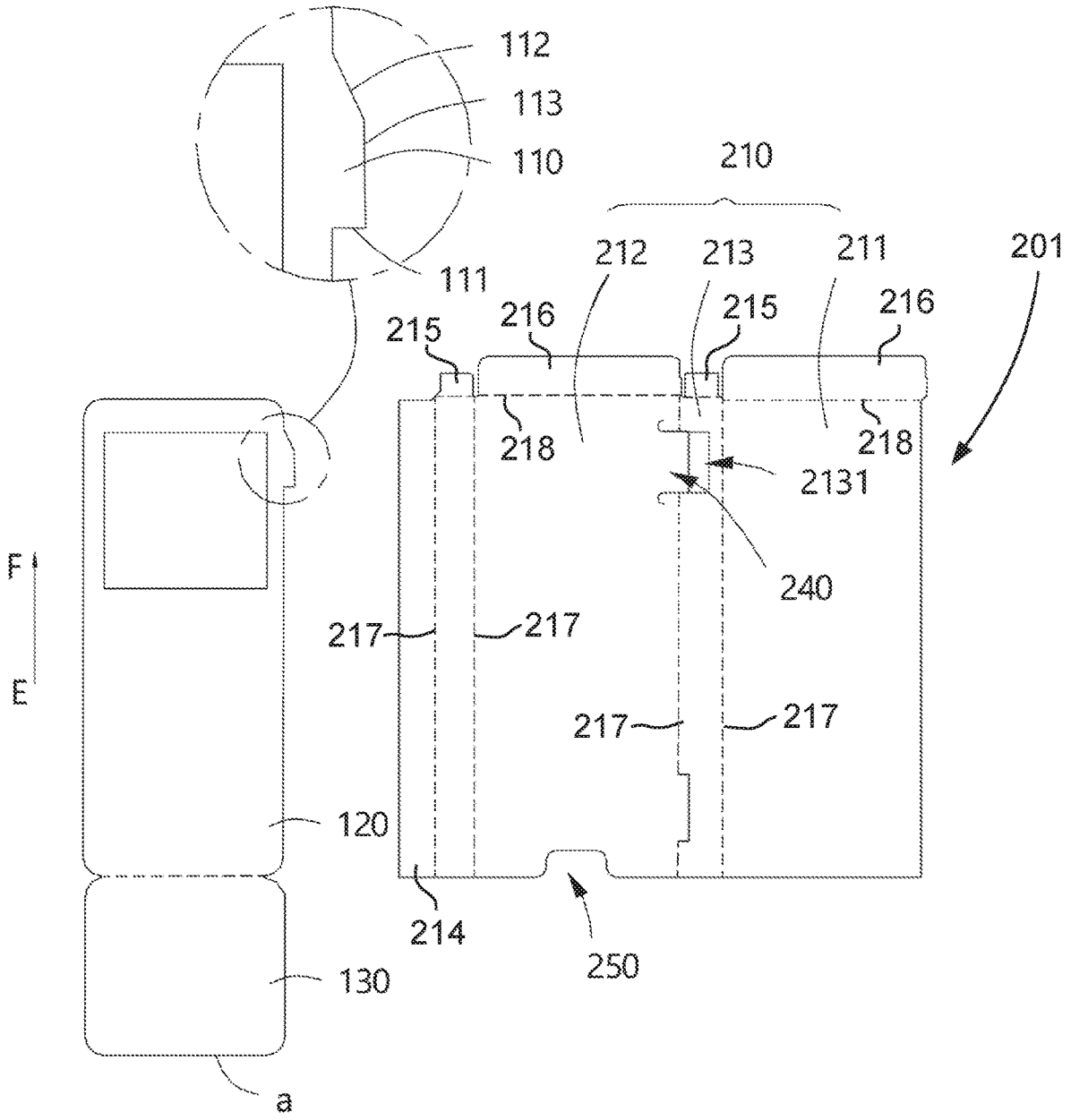
FIG. 2 is plan view of the unassembled tray and sleeve components of the package of FIG. 1.

Referring to FIGS. 1 and 2, a package is provided in accordance with an exemplary practice of the invention. The package can be made of a material having a certain elasticity, such as cardboard, sheet plastic, etc. The package includes a tray 100 and a sleeve 200. As shown in FIG. 1, the tray 100 and the sleeve 200 are in a disassembled state, where the tray 100 is pulled out of the sleeve 200. As shown in FIG. 2, the tray 100 and the sleeve 200 are both expanded. Dashed lines therein represent folding lines.

The sleeve 200 includes a plurality of panels 210. The panels 210 includes a back panel 211, a front panel 212, and a plurality of side panels 213 connecting the front panel 212 and the back panel 211. The back panel 211, the front panel 212, and the side panels 213 cooperatively form an inner cavity 220. The sleeve 200 defines an insertion opening 221 at a front end thereof for allowing insertion of the tray 100. The tray 100 can be inserted into the inner cavity 220 from the insertion opening 221 in a drawer-like manner.

FIG. 2 shows sleeve 200 as an unassembled blank 201. In addition to the above-described panels, the sleeve further includes a glue seam 214, side flaps 215, and end flaps 216. The back panel 211, the front panel 212, side panels 213, glue seam 214, side flaps 215, and end flaps 216 are defined and separated from each other by a plurality of vertical score lines 217 and horizontal score lines 218.

The sleeve 200 is assembled by folding the unassembled blank 201 along the vertical score lines 217 and gluing the glue seam 214 to a corresponding surface on the back panel 211 to form a tube with a rectangular profile. The side flaps 215 and end flaps 216 are folded inward along horizontal score lines 218 and glued together to form a sleeve end face 219. The sleeve inner cavity 220 is defined by the inner surfaces of the sleeve panels 210. The sleeve end face 219 provides a backstop for the inserted tray 100.

The sleeve 200 is provided with a rear locking slot 230 on a side panel 213. The tray 100 is provided with an elastic locking tab 110. When the tray 100 is inserted into a closed position inside the sleeve 200, the locking tab 110 is engaged with the rear locking slot 230 to lock the tray 100 in place relative to the sleeve 200. During the insertion of the tray 100, the locking tab 110 can be bent or deformed to a certain extent until the tray 100 moves to the closed position inside the sleeve 200 and the locking tab 110 extends through the rear locking slot 230.

Figure 7:
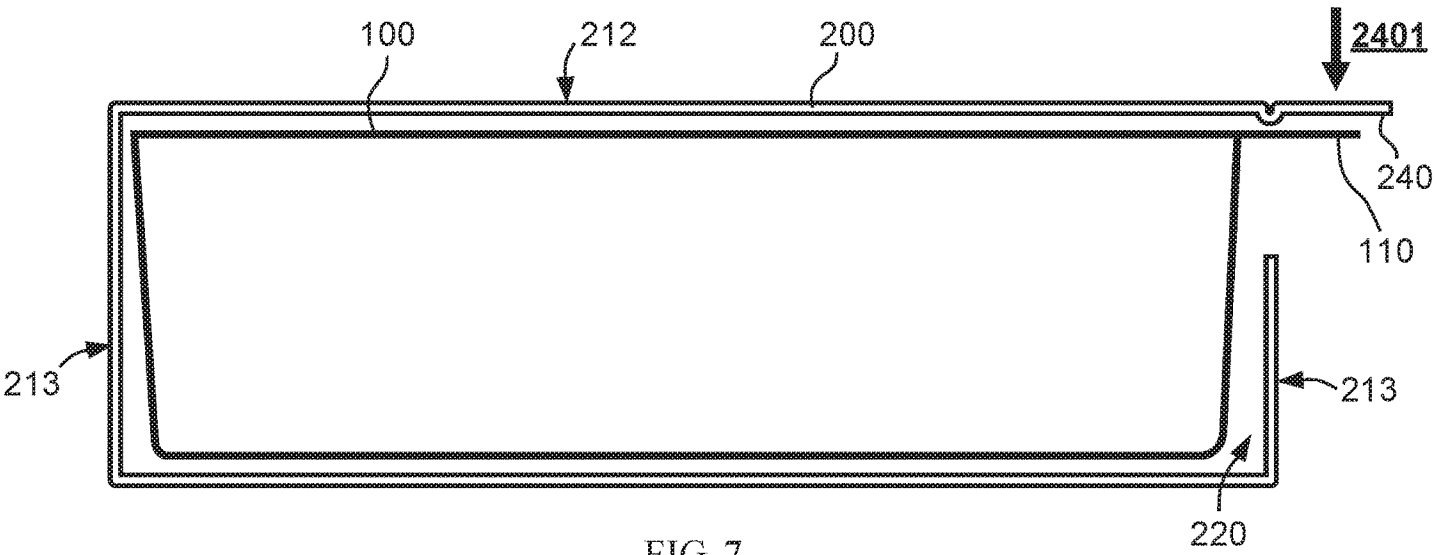
FIG. 7 is a cross-sectional view illustrating the package of FIG. 1, in which the tray is locked into its closed position with the sleeve.
Figure 8:
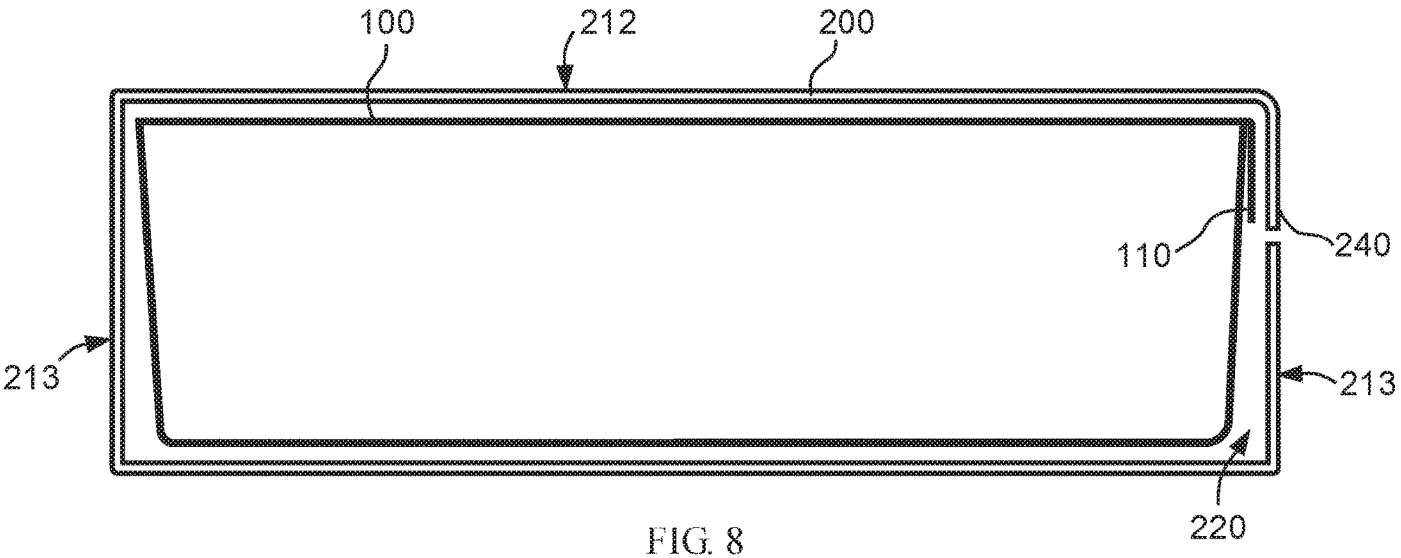
FIG. 8 is a cross-sectional view illustrating the package of FIG. 1, in which the sleeve release tab and the tray locking tab are deflected into their respective release positions.

The sleeve 200 further includes a release tab 240. The locked tray 100 is releasable by applying a suitable amount of pressure onto the release tab 240 in the direction of arrow 2401 (FIG. 7). Referring to FIGS. 7 and 8, when releasing the tray 100, the release tab 240 can be pressed or extruded to have an elastic deformation. The elastic deformation of the release tab 240 causes an elastic deformation of the locking tab 110 to press or extrude the locking tab 110 into the inner cavity 220, so as to detach the locking tab 110 from the rear locking slot 230. Thus, the tray 100 is released and can be pulled outward to provide access to package contents.

The tray 100 and the sleeve 200 can be locked via an engagement between the rear locking slot 230 and the locking tab 110. The locking mechanism serves a number of functions. First, it prevents children from gaining access to the contents. When opened, the locking mechanism keeps the two components connectable. Further, the two components are reclosable and re-lockable in order to maintain regulatory standards for child-resistance. The locking mechanism also prevents the tray 100 from dropping from the sleeve 200. The release tab 240 can be pressed or extruded to cause the locking tab 110 to retract into the inner cavity 220, thereby releasing the tray 100 from the sleeve 200. The structure of the package is simple and the locking and releasing operations are convenient.

In an exemplary practice of the invention, the release tab 240 and the sleeve 200 are integrally formed. For example, referring to FIG. 1 and FIG. 2, the release tab 240 can be formed by cutting a portion of a raw material that forms the sleeve 200, that is, a part of the raw material that forms the sleeve 200 is cut off via a cutting process. The remaining material can be folded along the folding line of FIG. 2, thereby forming the sleeve 200 with the rear locking slot 230 and the release tab 240.

Alternatively, it would be possible to manufacture the release tab 240 and the sleeve 200 separately. For example, part of the sleeve 200 can be cut off firstly to form the rear locking slot 230, and then a manufactured release tab 240 can be bonded with the sleeve 200 via adhesive, glue, a thermocompression process, etc. When the release tab 240 and the sleeve 200 are integrally formed, the release tab 240 and the sleeve 200 can be of the same material, and the manufacture of the release tab 240 and the sleeve 200 can be completed by cutting, thereby making the manufacture thereof convenient. When the release tab 240 and the sleeve 200 are separately manufactured, different materials can be flexibly selected to manufacture the release tab 240 and the sleeve 200, respectively.

Figure 3:
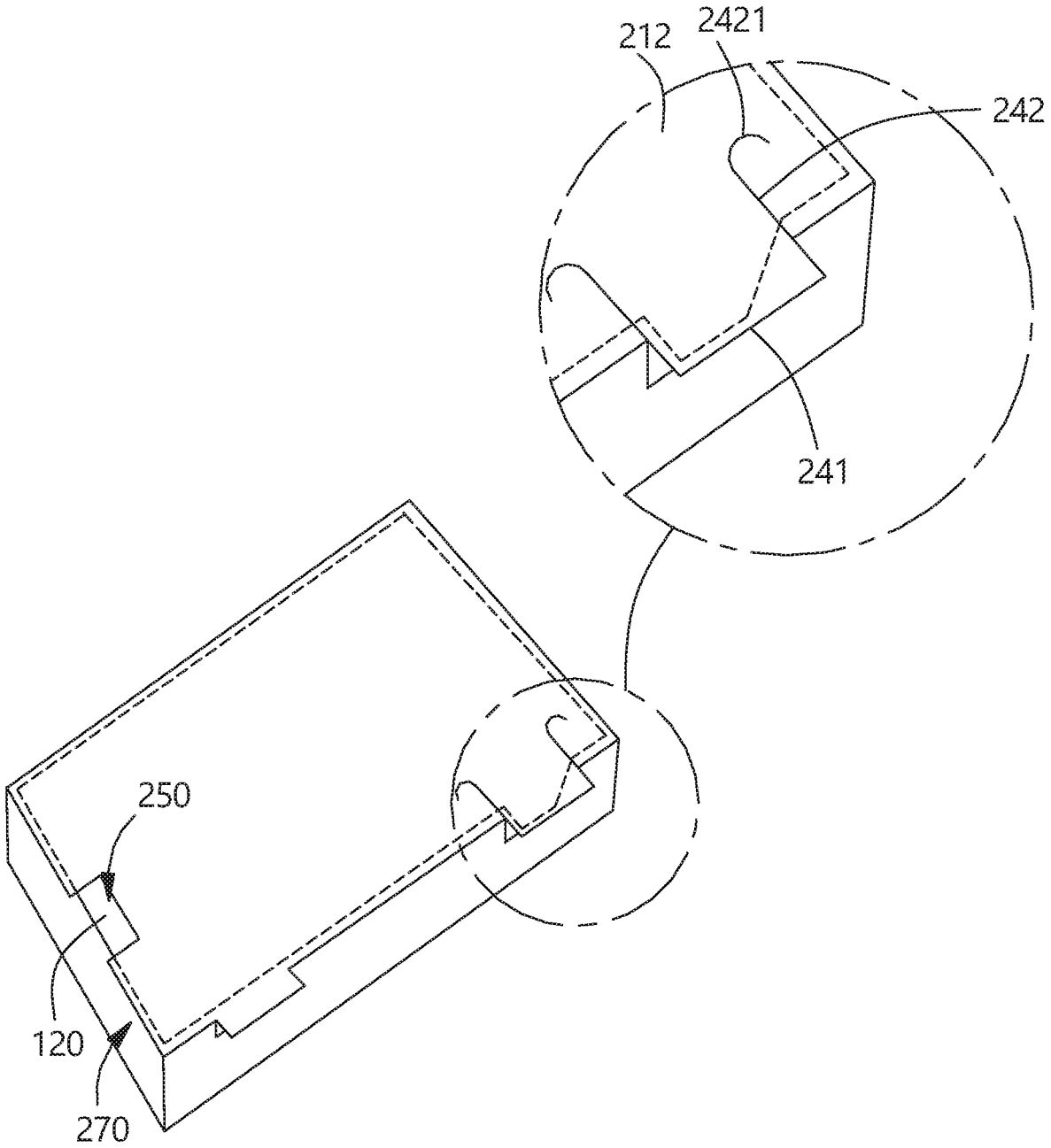
FIG. 3 is a perspective view of the package of FIG. 1, in which the tray has been seated into its closed, locked position within the sleeve.
Figure 4:
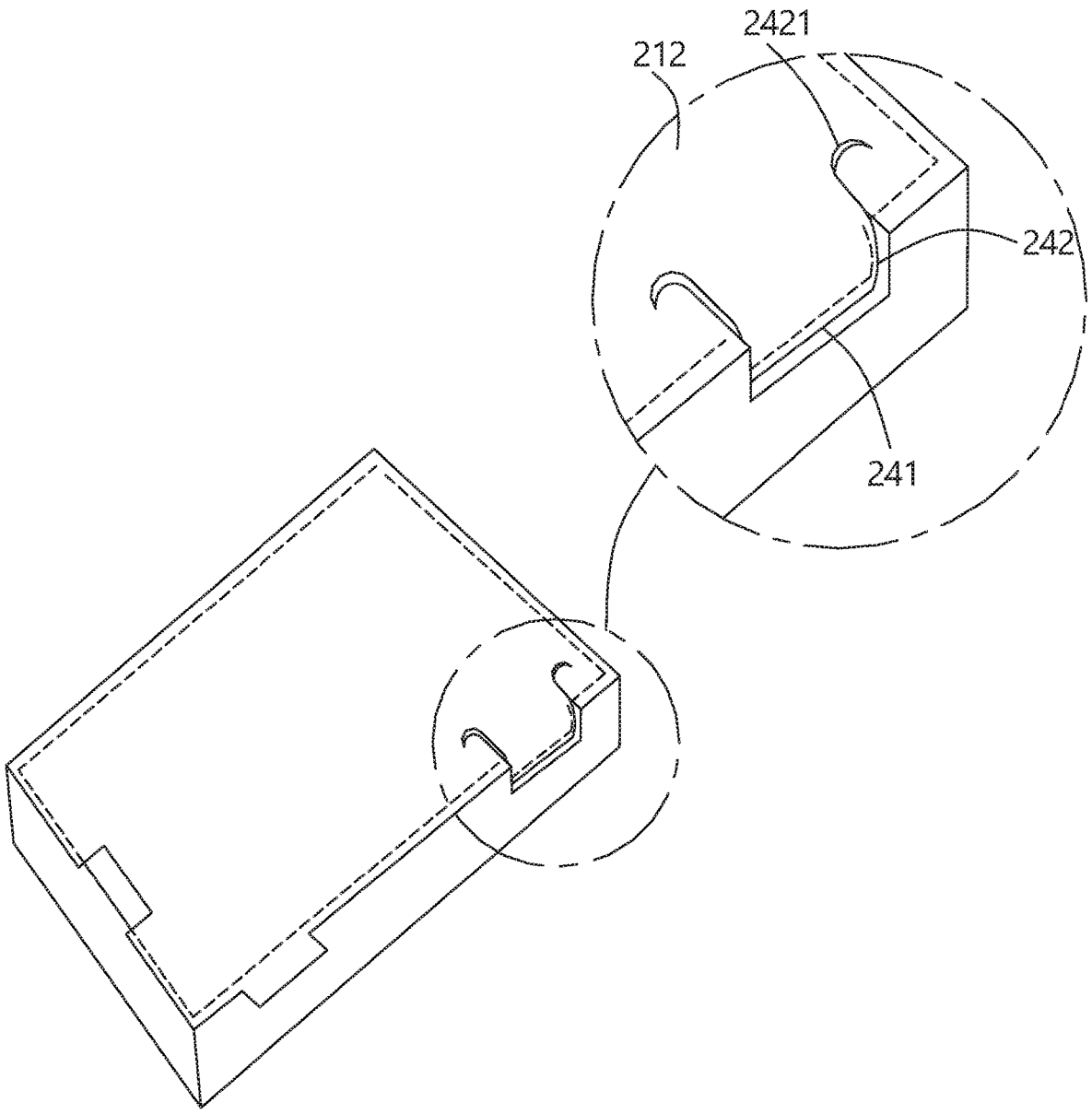
FIG. 4 is a perspective view of the package of FIG. 1, in which the sleeve's release tab and the tray's locking tab are deflected into their respective release positions.

In the present exemplary practice of the invention, the release tab 240 is described as extending outwardly from the sleeve front panel 212. Referring to FIGS. 1 and 2, the release tab 240 includes a free edge 241 and two side edges 242 connected to both ends of the free edge 241. An end of the release tab 240 away from the free edge 241 is fixed to the front panel 212. The rear locking slot 230 defines respective notches on two contiguous panels, i.e., front panel 212 and side panel 213. Referring to FIGS. 3 and 4, the end of the release tab 240 away from the free edge 241 is fixed to the front panel 212, and the side edges 242 extend into and connect to the front panel 212. When the release tab 240 is pressed, it is bent downward to press the locking tab 110.

An anti-tear portion 2421 is provided at an end of each side edge 242 connected to the front panel 212. The anti-tear portion 2421 can be, for example, a curved edge. The curved edges 2421 of the two side edges 242 extend along opposite directions. The anti-tear portion 2421 can be a semicircular edge. The purpose of the anti-tear feature 2421 is to protect the release tab from damage if a child attempts to breach the package by tearing the release tab 240 upward.

Referring to FIGS. 3 and 8, the release tab 240 is coplanar with the front panel 212 in a natural state. The release tab 240 has a certain elasticity capable of elastically deforming when being pressed. When the pressure applied to the release tab 240 disappears, the release tab 240 can return back to the natural state in which it is coplanar with the front panel 212.

Referring to FIGS. 7 and 8, the locking tab 110 is provided at a panel of the tray 100 adjacent to the release tab 240. In other words, the locking tab 110 is provided adjacent to the release tab 240 to reduce a distance between the locking tab 110 and the release tab 240, so that when pressing the release tab 240, the locking tab 110 can directly deform accordingly, thereby enabling the release of the tray 100 more convenient.

Referring to FIGS. 1 and 2, the locking tab 110 includes a locking edge 111, a guiding edge 112, and a transition edge 113 connected between the locking edge 111 and the guiding edge 112. When assembling the package, the tray 100 is inserted into the inner cavity 220 of the sleeve 200 along the direction of the arrow EF. The guiding edge 112 enters the insertion opening 221 prior to the locking edge 111. The locking tab 110 can be a right-angled trapezoid shaped. The locking edge 111 can be a right-angled waist of the right-angled trapezoid, that is, the locking edge 111 vertically extends from an edge of the tray 100. The guiding edge 112 can be an oblique waist of the right-angled trapezoid, that is, the guiding edge 112 tilts to the edge of the tray 100. The transition edge 113 is connected between the locking edge 111 and the guiding edge 112, and is parallel to the edge of the tray 100. When the tray 100 is in the closed position and the locking tab 110 extends through the rear locking slot 230, the locking edge 111 is engaged by the rear locking slot to prevent the tray 100 from being pulled out of the sleeve 200. During the insertion of the tray 100, the guiding edge 112 enables the locking tab 110 to elastically deform much more easily, since the guiding edge 112 is oblique with respect to the insertion direction of the tray 100, thereby enabling the insertion of the tray 100 much more easily. The locking tab 110 and the tray 100 can be integrally formed. Alternatively, the locking tab 110 and the tray 100 can be manufactured separately, and then coupled to each other via adhesive, thermocompression, etc.

As shown in FIG. 2, the locking tab 110 is shaped as a trapezoid having a right-angled leg and an oblique leg, wherein the locking edge 111 is the right-angled leg of the trapezoid, the guiding edge 112 is the oblique leg of the trapezoid, and the transition edge 113 is a base of the trapezoid.

Referring to FIG. 3, a length of the tray 100 along the insertion direction is less than or equal to a length of the sleeve 200 along the insertion direction, thereby the tray 100 can be easily inserted into the inner cavity 220 of the sleeve 200 completely. Referring to FIG. 1, the sleeve 200 is further provided with a front locking slot 260. The front locking slot 260 is configured to engage the locking tab 110 only when the tray 100 is being pulled out of the sleeve 200. Thus, the front locking slot 260 defines the maximum distance that the tray can be opened relative to the sleeve 200. The front locking slot 260 and the rear locking slot 230 are located on the same side panel 213. Compared to the rear locking slot 230, and the front locking slot 260 is disposed closer to the insertion opening 221. When the locking tab 110 is inserted into the front locking slot 260, the tray 100 and the sleeve 200 are in a released state, and contents in the tray 100 can be taken out at this time.

Figure 5:
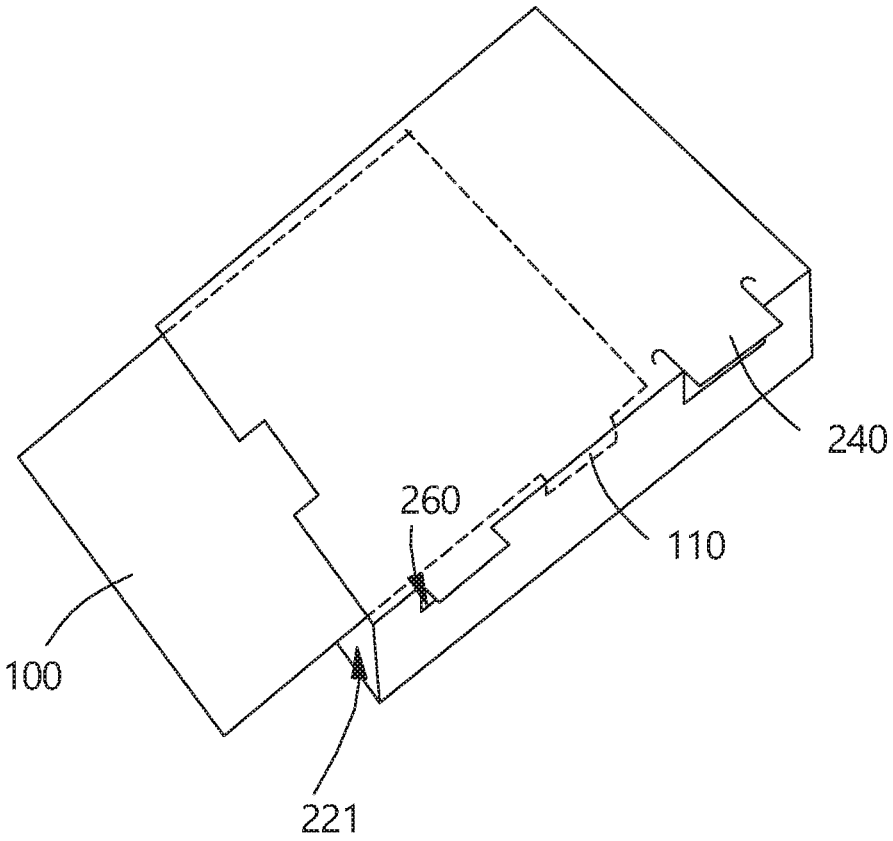
FIG. 5 is a perspective view of the package of FIG. 1, in which the unlocked tray has pulled forward into a half-open position.
Figure 6:
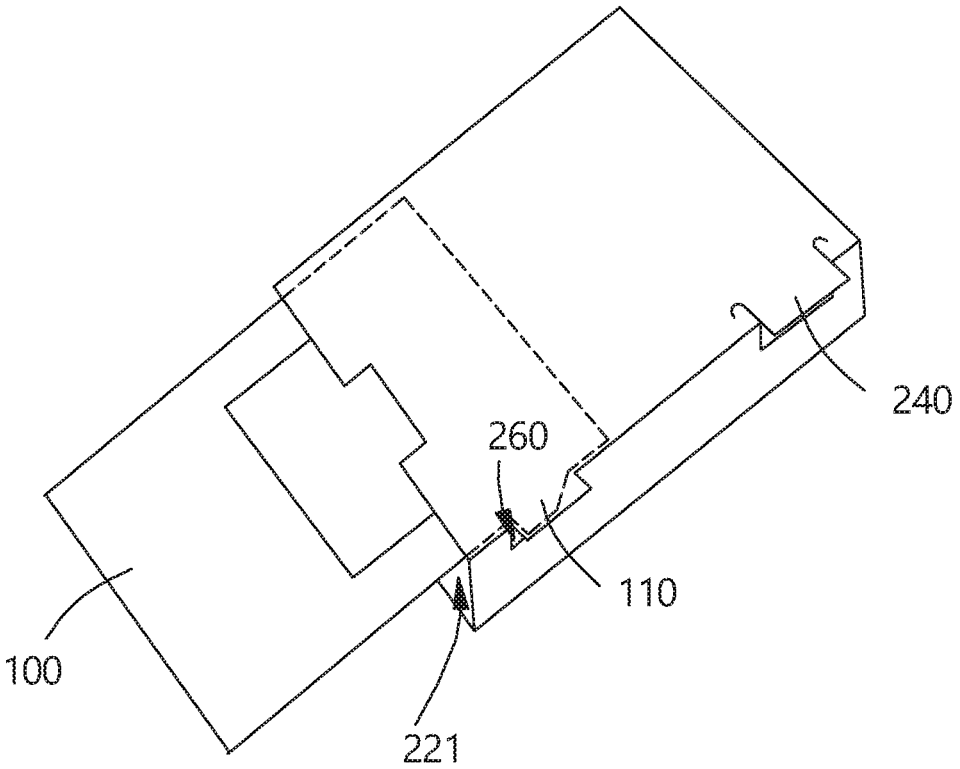
FIG. 6 is a perspective view of the package of FIG. 1, in which the tray has been pulled forward and locked into its forward position.

Referring to FIGS. 5 and 6, when the release tab 240 is pressed, the locking tab 110 is elastically deformed to retract into the inner cavity 220 accordingly in a bending state. Then the tray 100 can be pulled to move outward. During the movement, the locking tab 110 maintains the bending state. When the locking tab 110 moves to a position corresponding to the front locking slot 260, the locking tab 110 returns to the natural state due to its own elasticity and extends through the front locking slot 260, thereby preventing the tray 100 from dropping from the sleeve 200, and the contents in the tray 100 can be taken out.

Referring to FIGS. 1 and 2, the rear locking slot 230 is located at the front panel 212 and the side panel 213. Along a short edge direction of the side panel 213, a length of the rear locking slot 230 is greater than a length of the front locking slot 260, since the rear locking slot 230 needs to cooperate with the release tab 240 to press the locking tab 110 to retract into the inner cavity 220. When manufacturing the rear locking slot 230, part of the raw material that forms the sleeve 200 can be cut off to form a processing hole 2131 on the side panel 213. The processing hole 2131 is an opening of the rear locking slot 230 on the side panel 213. The front locking slot 260 can be defined by three connected cuts. The three connected cuts include a free cut and two opposite side cuts. The two side cuts intersect with a folding line. When folding the raw material to form the sleeve 200, the front locking slot 260 is defined.

The front locking slot feature can be advantageously used in a package designed for multiple uses, such as a package that contains multiple product items, in which not all of the packaged items are removed at once. The front locking feature allows the tray and sleeve to opened and securely closed multiple times, while the tray and sleeve remain connected together. It is noted that the front locking slot, in combination with other practices of the invention described herein, provide a combination of features that can be used to fabricate a package meeting the most stringent regulatory standards regarding child-resistant and senior-friendly packages.

One panel 210 of the sleeve 200 defines a finger-receiving notch 250, which is adjacent to the insertion opening 221. Referring to FIGS. 1 and 2, the finger-receiving notch 250 is defined at the front panel 212. The tray 100 further includes a pulling plate 120 corresponding to the finger-receiving notch 250. After the tray 100 is inserted into the sleeve 200, the pulling plate 120, the back panel 211, and the two side panels 213 cooperatively define an accommodation space 270 for accommodating a finger. Further referring to FIG. 3, when the tray 100 is inserted into the sleeve 200, a part of the pulling plate 120 is exposed from the finger-receiving notch 250. A user can use one hand to press the release tab 240, and use two fingers of the other hand to grip the pulling plate 120 from the accommodation space 270 and the finger-receiving notch 250 respectively, to pull the tray 100 out of the sleeve 200 from the insertion opening 221.

Referring to FIG. 1, the tray 100 further includes a protective sheet 130. One end of the protection sheet 130 is rotatably connected to the pulling plate 120. The other end of the protection sheet 130 away from the connected end extends into the inner cavity 220 and abuts against the front panel 212. When the tray 100 is inserted into the inner cavity 220, the end a of the protection sheet 130 abuts against the front panel 212, thereby preventing the contents in the tray 100 from dropping from a gap between the tray 100 and the sleeve 200. End flaps 216 are glued together, providing a backstop to prevent the tray from being pushed in too far.

In the aforementioned package, the tray 100 and the sleeve 200 of the package can be locked via the engagement of the rear locking slot 230 and the locking tab 110, thereby preventing the tray 100 from dropping from the sleeve 200. In addition, the package can be used to contain contents that are not suitable for children to reach, such as drugs, since it is difficult for children who use the package for the first time to release the package, thereby preventing potential dangers to the children.

ADDITIONAL DESCRIPTION OF THE INVENTION

There are now presented further details relating to the structural components of the tray and sleeve described above. Also described below are exemplary packages according to further practices of the invention.

FIGS. 9A-9D are a series of cutaway perspective views of an assembled package 20 comprising the tray 100 and sleeve 200 described above. The purpose of FIGS. 9A-9D is to provide a sequential illustration of the operation of the locking tab 110 in conjunction with the rear locking slot 230 and the front locking slot 260.

For the purposes of the present section, the term "front end" refers to the end of the sleeve at which the insertion opening 221 is located; the term "rear end" refers to the end of the sleeve distal from the insertion opening; and the term "rear panel" refers to the sleeve side panel located at the rear end of the sleeve.

Figure 9B:
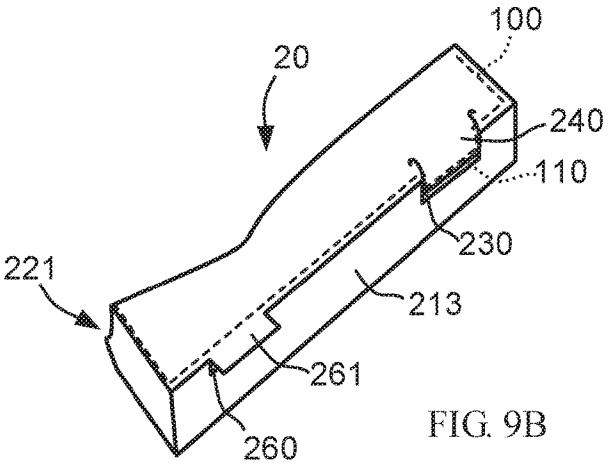
FIGS. 9A-9D are a series of cutaway perspective views of the assembled package of FIG. 1.
Figure 9D:
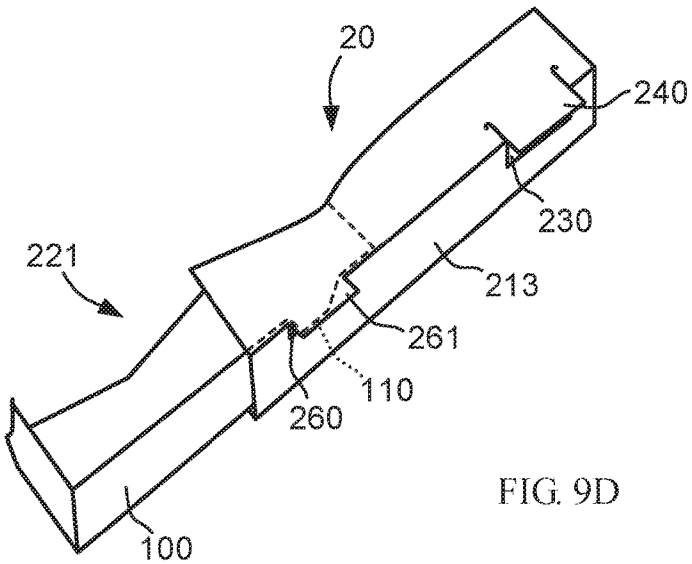
Figure 9A:
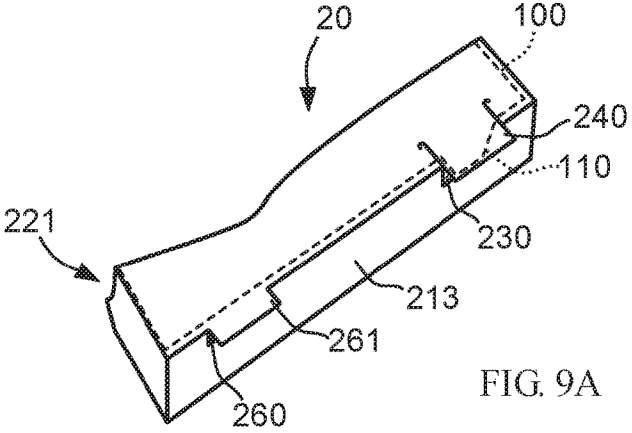

FIG. 9A shows the tray 100 seated in its closed position proximate to the rear end of the sleeve 200. In its closed position, the locking tab 110 extends outward through the rear locking slot 230, generally parallel with the sleeve front panel 212, and generally perpendicular with the side panels 213. Movement of the tray 100 outside of the rear end of the sleeve is blocked by contact between the tray and the end face 219 located at the rear of the sleeve 200.

When the tray 100 is seated in its closed position with the sleeve 200, movement of the tray 100 out of the sleeve insertion opening 221 is blocked by contact between a leading edge of the locking tab 110 and a corresponding edge of the rear locking slot 230. According to an aspect of the invention, the material for the tray 100 and sleeve 200 is chosen to have a requisite amount of strength and stiffness to provide a firm locking action when the leading edge of the locking tab 110 engages the edge of the rear locking slot 230. Other criteria for the choice of material include deflectability and resiliency, such that it is easy for a typical adult to bend both the release tab 240 and the locking tab 110 downward, and such that once the downward pressure is released, both the release tab 240 and the locking tab 110 resiliently return to their original positions.

As further shown in FIG. 9A, the sleeve release tab 240 is positioned such that when the tray 100 is seated in its rear locked position, the sleeve release tab 240 overlies the tray locking tab 110. Thus, as shown in FIG. 9B, pressing down on the sleeve release tab 240 causes the tray locking tab 110 to be downwardly deflected, such that the locking tab 110 no longer engages the rear locking slot 230. Typically, an adult uses one hand to hold the release tab 240 and locking tab 110 in their downwardly deflected positions, and uses the other hand to slide the tray 100 in the direction of the front end of the sleeve 200.

Figure 9C:
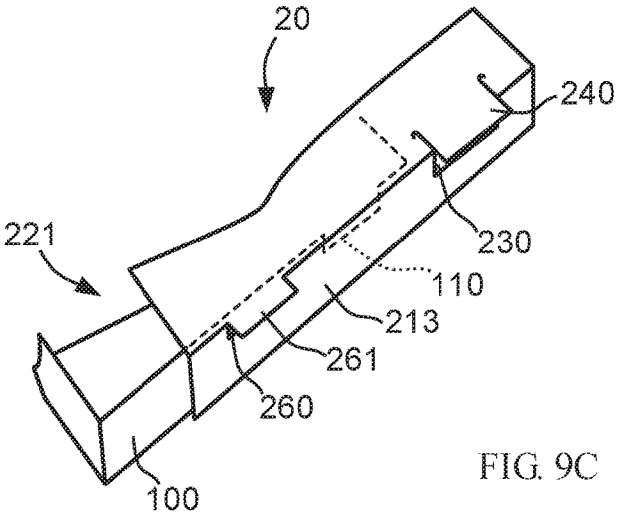

In FIG. 9C, the tray 100 has been slid approximately halfway towards its front, open position. The release tab 240 has returned to its original position, lying flat in substantially the same plane as the sleeve front panel 212. The locking tab 110 butts up against the interior surface of the adjacent side panel 213, and thus remains in its downwardly deflected position as the tray slides along.

In FIG. 9D, the tray 100 is seated in its forward, open position proximate to the front end of the sleeve 200. When the locking tab 110 lines up with the front locking slot 260, the resilience of the locking tab 110 causes it to be urged upward through the front locking slot 260, into its original, outwardly-extending position. The portion of the locking tab 110 extending outside of the front locking slot 260 is covered with an overhang 261 that extends outwardly from the front panel. When the tray 100 is seated in its forward position, continued movement of the tray 100 in the forward direction is blocked by engagement of a leading edge of the locking tab 110 with a corresponding edge of the front locking slot 260.

As described above, the locking tab 110 and front locking slot 260 are configured such that movement of the tray 100 in a rearward direction is not blocked. According to a practice of the invention, this is achieved by providing the locking tab 110 with a rearward-facing guiding edge 112. The guiding edge 112 is tapered such that when the tray is moved in a rearward position, the initial point of contact between the guiding edge 112 and the front locking slot 260 is proximate to the base of the locking tab 110, and proximate to the sleeve front panel 212. As the tray 100 is moved in a rearward direction within the sleeve 200, the point of contact between the guiding edge 112 and the front locking slot 260 moves downward, causing the locking tab 110 to be deflected downward until it is clear of the front locking slot 260.

Figure 11:
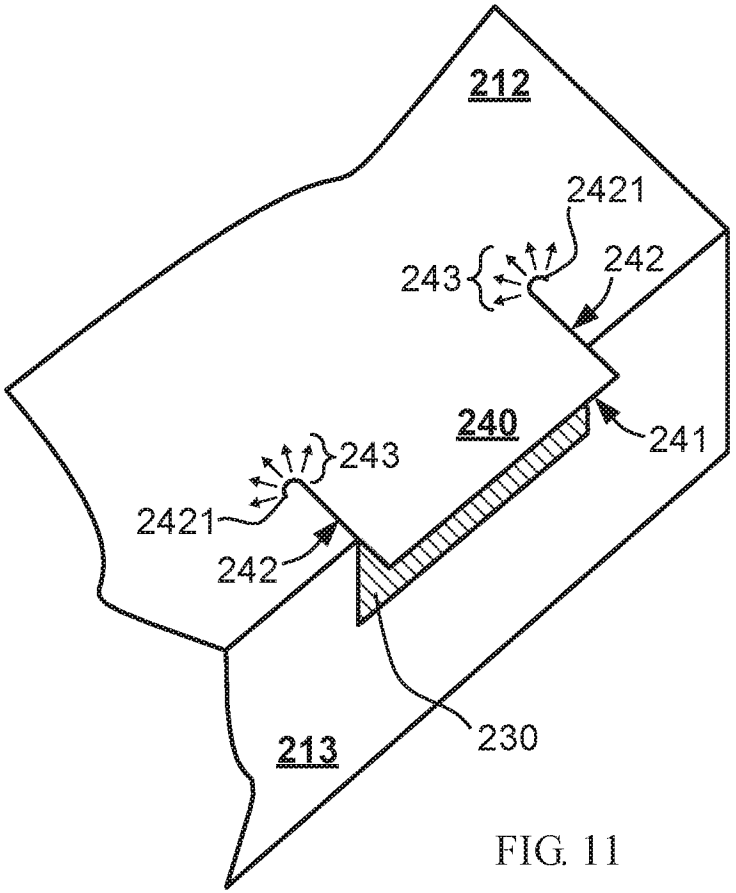
FIGS. 10 and 11 are a pair of drawings illustrating the sleeve release tab and anti-tear feature in the package of FIG. 1.
Figure 10:
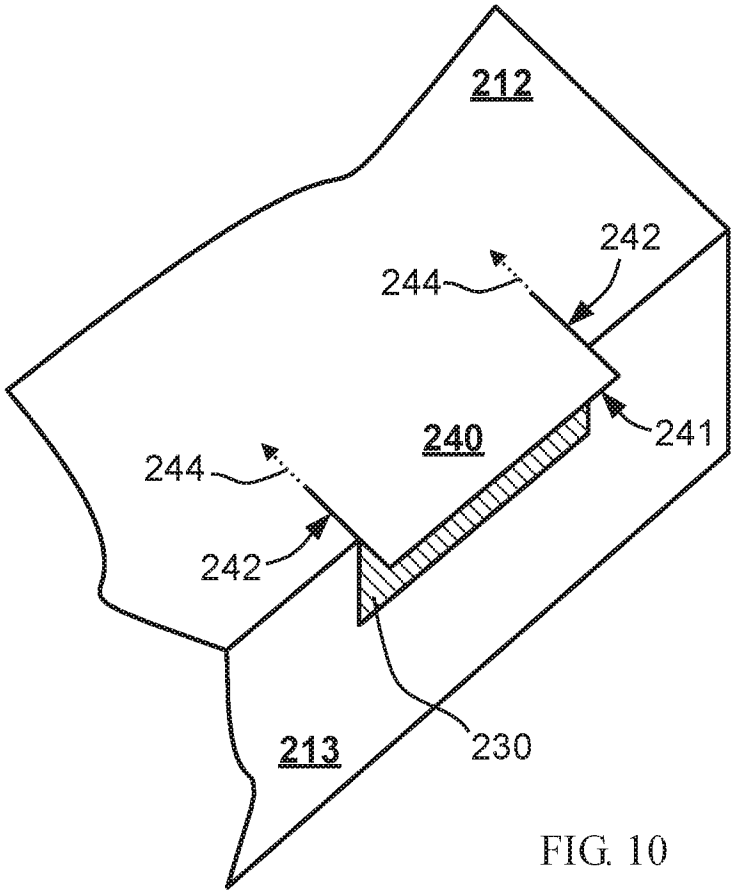

FIGS. 10 and 11 are a pair of drawings illustrating the sleeve release tab and anti-tear feature discussed above in conjunction with FIGS. 3 and 4. FIG. 10 shows a closeup view of the sleeve release tab 240 without an anti-tear feature, and FIG. 11 shows a closeup view of the sleeve release tab 240 with an anti-tear feature 2421. In both FIGS. 10 and 11, the release tab 240 comprises a free edge 241 and a pair of side edges 242.

It will be seen in FIG. 10 that pulling upward on the release tab 240 will exert a shear force at the base of each of the side edges 242. This shear force has the potential to cause tears to develop in the general direction of broken arrows 244, thereby providing access to the contents of the tray, and otherwise damaging the overall integrity of the package.

As shown in FIG. 11, as illustrated by arrows 243, when the release tab 240 is pulled upward, the resulting shear force is now distributed around each curved edge 2421, thereby tending to prevent the above-described damage to the sleeve front panel 212.

Figures 12A, 12B:
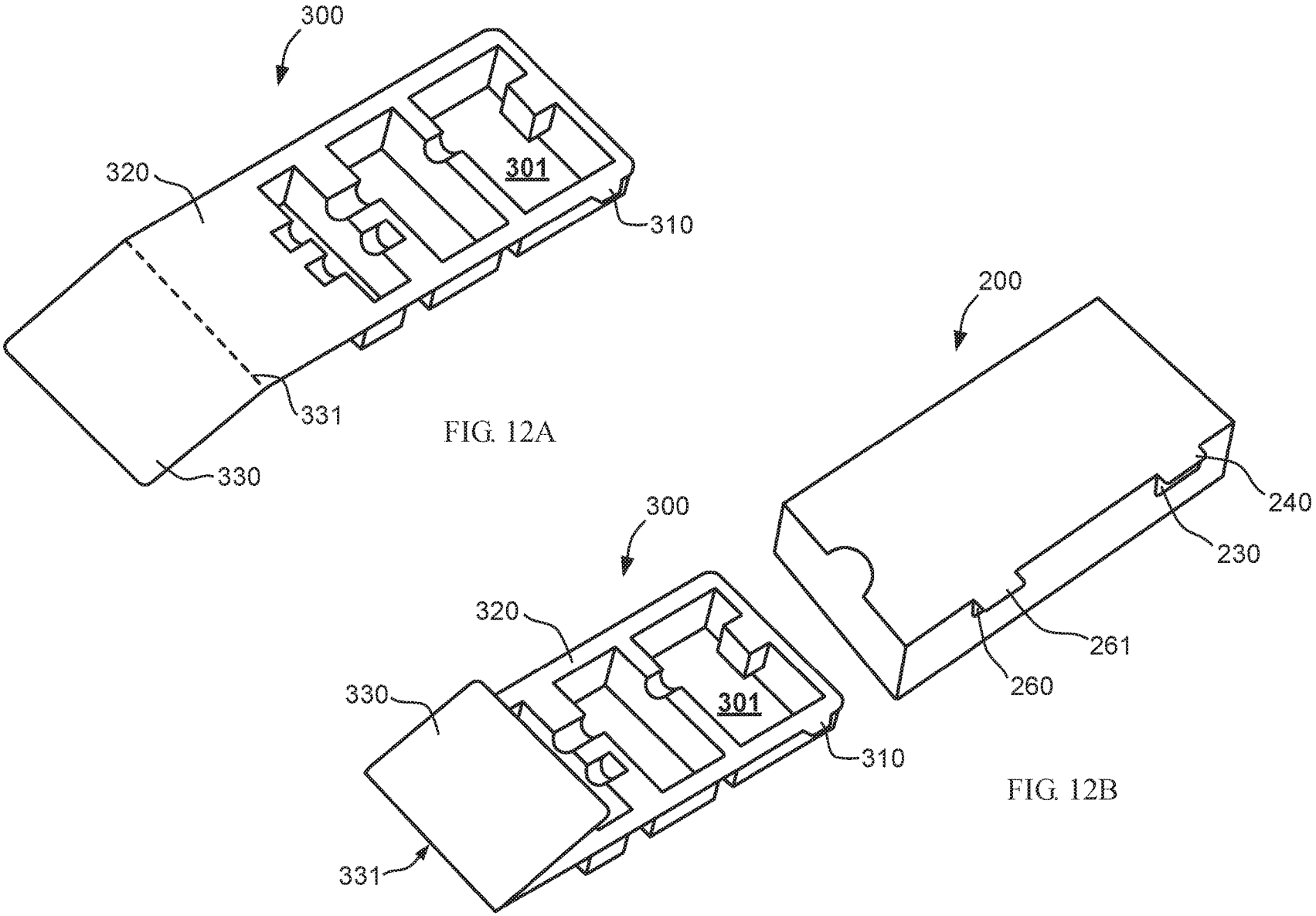
FIGS. 12A and 12B are a pair of drawings illustrating a tray and protection sheet according to an aspect of the invention.

FIG. 12A shows a drawing of an exemplary tray 300 according to a further aspect of the invention. The tray 300 is fabricated from a sheet of a suitable plastic that has been thermoformed to create a plurality of compartments 301 for holding one or more retail items to be packaged. The non-contoured area of the tray and flange are trimmed and scored to create the tray upper plate 320 and locking tab 310.

As shown in FIG. 12A, protection sheet 330 is formed by trimming the upper plate 320 to include an extended front section that is defined by a score line 331 at the desired front edge of the upper plate 320. As shown in FIG. 12B, the protection sheet 330 is then folded along the score line 331 for insertion into sleeve 200.

The protection sheet 330 serves a number of purposes. One purpose is to provide structural reinforcement for the front portion of the upper plate 320. The protection sheet 330 prevents a child from bending and otherwise distorting the tray 300 to gain access to the package contents.

Figure 13A:
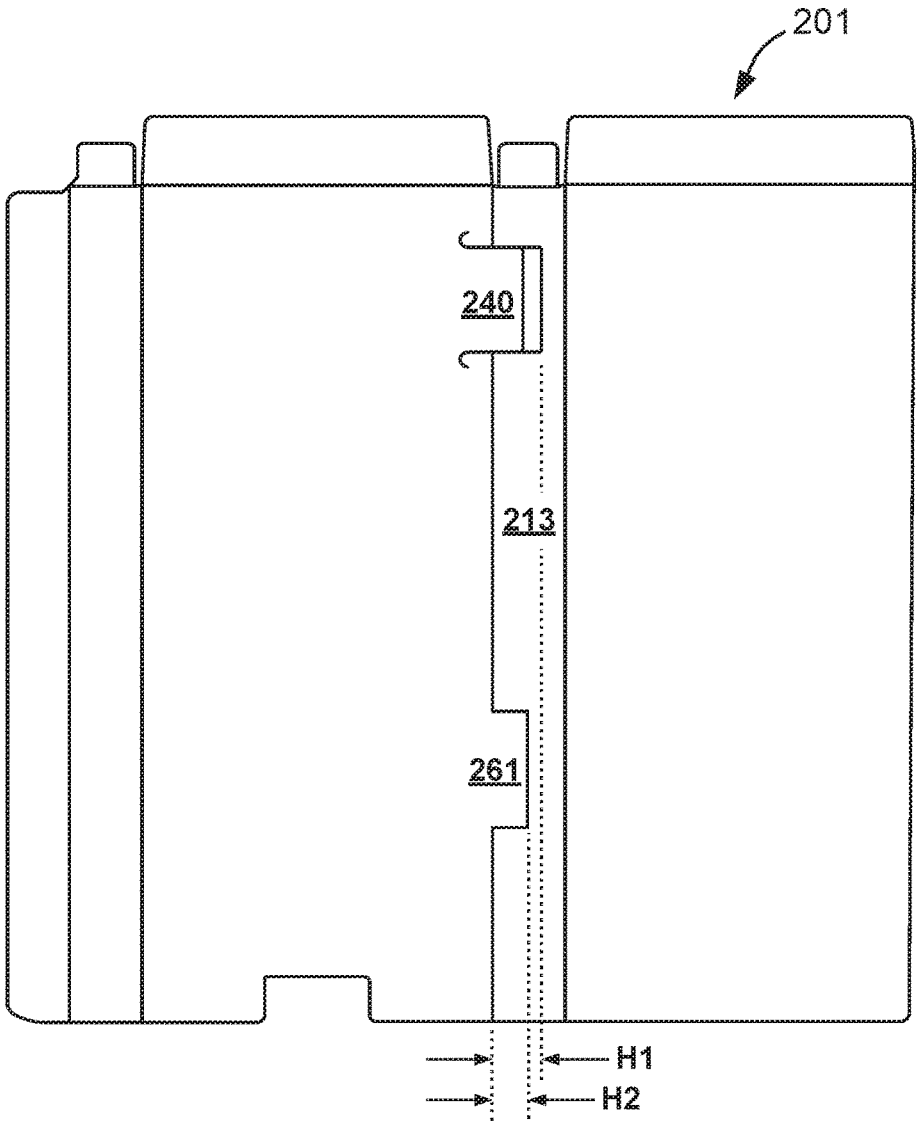
FIGS. 13A-13C are a set of drawings that illustrate the operation of the front locking slot to prevent the tray from being pulled out the sleeve, while allowing it to be pushed back into its closed, locked position.
Figure 13B:
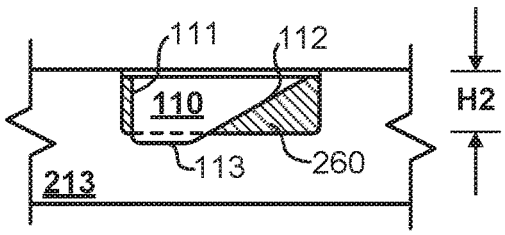
Figure 13C:
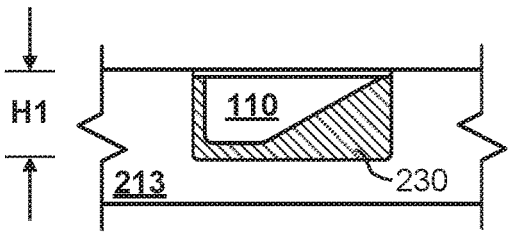

According to a practice of the invention, illustrated in FIGS. 13A-13C, the front locking slot is shallower than rear locking slot. In FIG. 13A, the unassembled sleeve blank 201 shown in FIG. 2 has been redrawn to illustrate the height H1 of the rear locking slot 230 and the height H2 of the front locking slot 260. FIG. 13B shows a side view of the front locking slot 260 in the assembled package, in which the tray is locked into its forward, open position with locking tab 110 extending outward through the front locking slot. FIG. 13C shows a side view of the rear locking slot 230 in the assembled package, in which the tray is locked into its rear, closed position with locking tab 110 extending outward through the rear locking slot. In both FIG. 13B and FIG. 13C, for the purposes of the present discussion, the locking tab 110 has been fully deflected downward.

As illustrated in FIG. 13B, the height H2 of the front locking slot 260 relative to the height of the locking tab 110 provides an anti-release function. The height H2 of the front locking slot 260 is configured to provide enough clearance such that when the tray is slid forward from the back of the sleeve towards the front, and such that the locking tab 110 is aligned with the front locking slot 260, the resiliency of the locking tab 110 causes it to spring outward through the front locking slot. Further movement of the tray in the forward direction is prevented by contact between the locking edge 111 of the locking tab 110 and a corresponding edge of the front locking slot 260.

The height H2 of the front locking slot 260 is further configured such that if a user attempts to release the lock by deflecting the locking tab downward, the transition edge 113 of the locking tab 110 catches on the bottom edge of the front locking slot 260, thereby preventing the locking tab 110 from being deflected all the way through the front locking slot 260. When the tray is moved towards the rear of the tray, contact between the sloped guiding edge 112 of the locking tab and the rear edge of the front locking slot 260 causes the locking tab 110 to be pulled into the sleeve interior, thereby releasing the lock.

As shown in FIG. 13C, the height H1 of the rear locking slot 230 is configured to allow free deflection of the locking tab 110 into the sleeve interior.

Figure 14A:
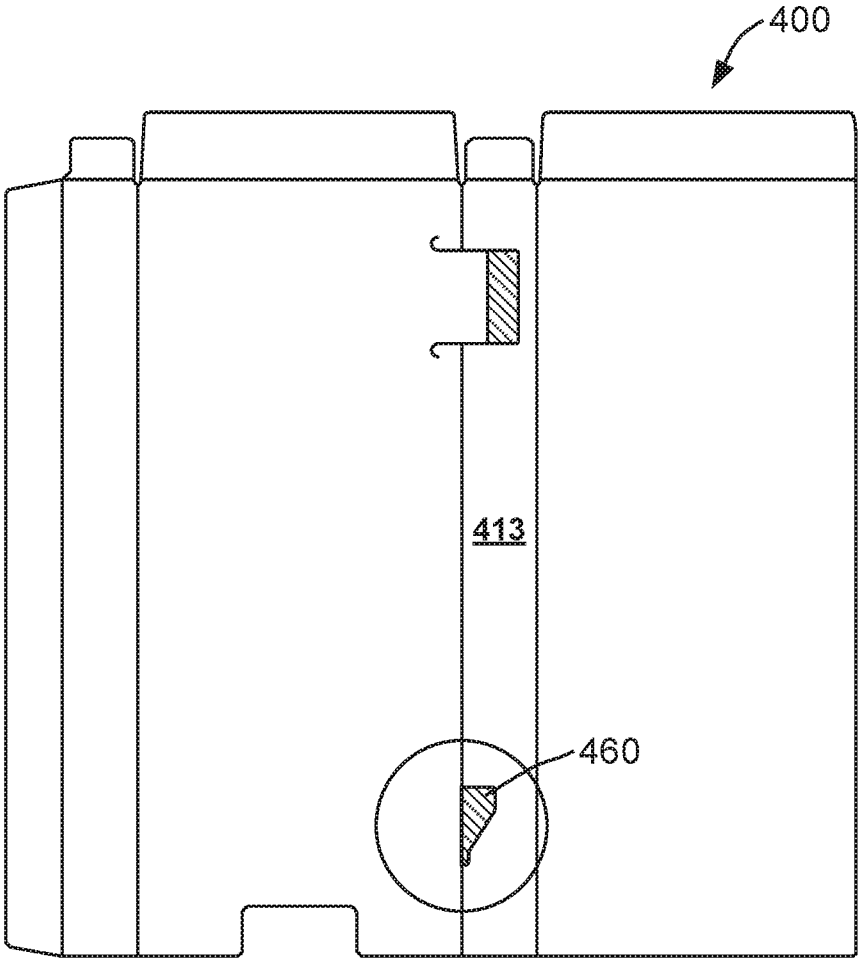
FIGS. 14A-14C are a set of drawings that illustrate an alternative front locking slot according to a further aspect of the invention.
Figure 14B:
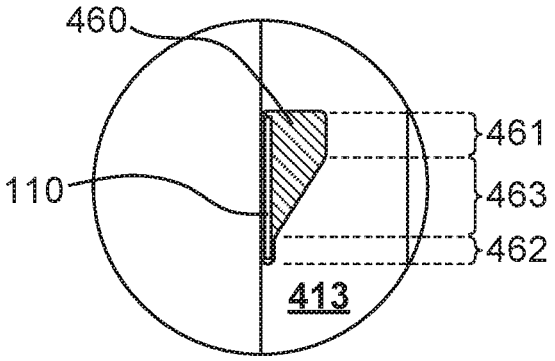
Figure 14C:
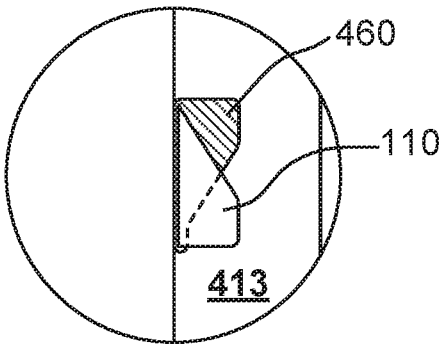

In a further practice of the invention illustrated in FIGS. 14A-14C, a front locking slot having a different shape is used to provide the above-described anti-release feature. FIG. 14A shows an unassembled sleeve blank 400 having a side panel 413 that incorporates the alternative front locking slot 460. FIG. 14B shows a closeup view of the front locking slot in an assembled package in which the undeflected locking tab extends through the front locking slot. FIG. 14C shows a closeup view of the assembled package, in which the locking tab has been deflected downward.

The front locking slot 460 is configured to provide a tail region 461 having a width that allows the locking tab 110 to extend through the locking slot 460, a lead region 462 having a width that is sufficiently narrow to prevent the locking tab 110 from being downwardly deflected back through the locking slot 460, and a tapered transition region 463 having a width that is tapered to provide a transition between the width of the tail region 461 and the width of the lead region 462. As illustrated in FIG. 14C, if a user attempts to use downward deflection to release the locking tab from the front locking slot, the leading edge of the locking tab will be blocked by a portion of the side panel 413 adjacent to the front of the locking slot.

As further shown in FIG. 14C, the front locking slot 460 and the locking tab 110 are shaped such that when the tray is slid from the rear of the sleeve to the front, the locking tab will unfold as its guiding edge rides along the rearward edge of the front locking slot until it reaches its fully undeflected position. Similar to the arrangement shown in FIGS. 13A-13C, when the tray is moved towards the rear of the tray, contact between the sloped guiding edge of the locking tab and the rear edge of the front locking slot causes the locking tab to be pulled into the sleeve interior, thereby releasing the lock.

Figure 15C:
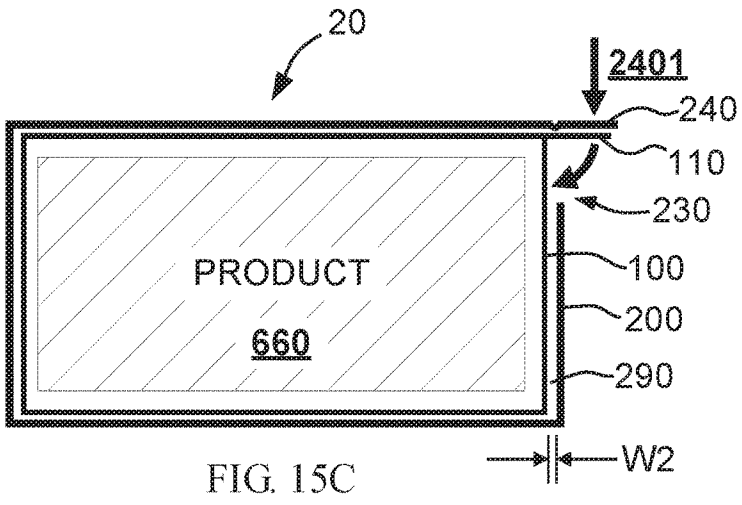
FIGS. 15A-15D are a series of drawings illustrating the differences between a package with a "push-in" release tab according to the prior art and a package with a "press-down" release tab according to the present invention.
Figure 15D:
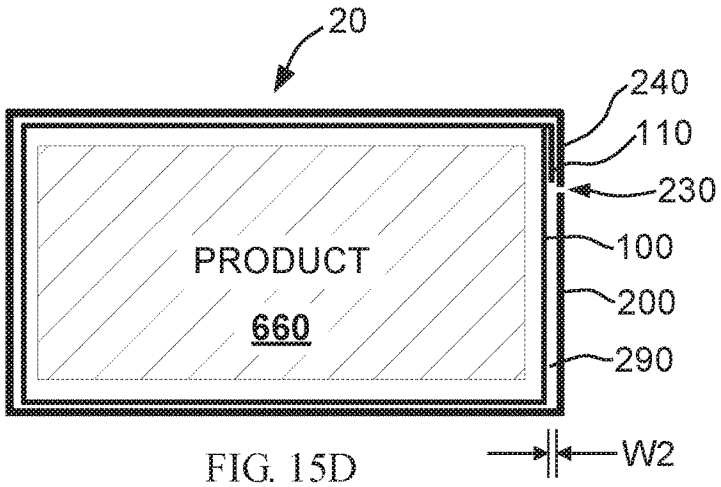
Figure 15A:
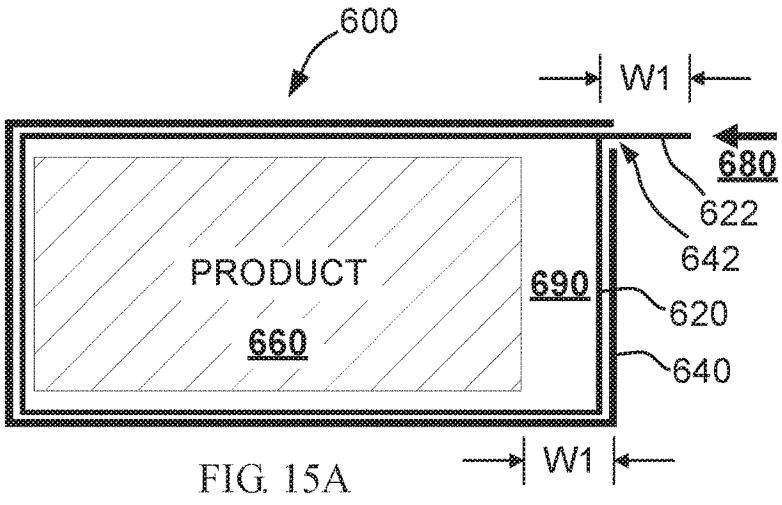
FIG. 15A (prior art)
Figure 15B:
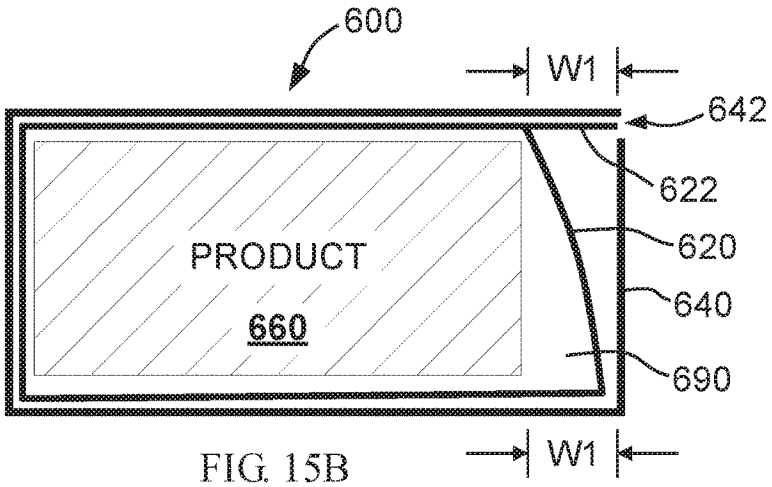
FIG. 15B (prior art)

FIGS. 15A-15D are a series of drawings comparing an exemplary package according to the prior art with an exemplary package according to the present invention. FIGS. 15A and 15B show a pair of transverse cross-section views of an exemplary tray-and-sleeve package 600 according to the present invention; FIGS. 15C and 15D show a pair of transverse cross-section views of an exemplary package according to the prior art. For the purposes of the present description, the release mechanism of the prior art package 600 is referred to as a "push-in" tab. The release mechanism of a package according to the present invention is referred to as a "press-down" tab.

Referring to FIGS. 15A and 15B: prior art package 600 includes a tray 620 and sleeve 640 for holding a product 660. The tray 620 is provided with a locking tab 622, and the sleeve 640 is provided with a locking slot 642. When the package 600 in its closed position, the tray 620 is locked into position by the edges of the locking tab 622 butting up against corresponding edges of the locking slot 642. In the prior art package 600, the tray 620 is unlocked by pushing the locking tab 622 through the locking slot in the direction of arrow 680. Once the locking tab 622 is clear of the locking slot 642, the tray 620 can then be moved out of its locked position.

The package shown in FIGS. 15C and 15D operates as described above. Tray 100 is released from its locked position by pressing down on release tab 240 in the direction of arrow 2401, which causes the locking tab 110 to be deflected downward until it clears the edges of the rear locking slot 230.

As illustrated in FIGS. 15A-15D, there are a number of differences between a "push-in" design and a "press-down" design. As shown in FIGS. 15A-15B, in the prior art design, extra space 690 is required within the package to provide sufficient room for the locking tab to be pushed into its released position. The amount of extra space must have a width W1 that is equivalent to the width of the locking tab protruding out of the package. The additional space required for a "push-in" tab to function adds unnecessary material/cost to the package. The package also cannot be designed to hold the product snugly which may result in damage due to the product movement when shipped.

As shown in FIGS. 15C-15D, in a package according to the present invention, the "press-down" release structure requires a space 290 having a width W2 that is sufficient to accommodate the thickness of the downwardly-deflected locking tab. The required space 290 is negligible, and is typically already present in a tray-and-sleeve package design, without the need to provide additional space.

Materials and Manufacturing Considerations

In an exemplary practice of the invention, the tray and sleeve are fabricated from a plastic material that is chosen based upon a number of criteria, including strength, durability, stiffness, resiliency, machineability, and cost. One plastic that can be suitably employed, for example, is polyethylene terephthalate (PET).

For example, sleeve blanks can be formed by feeding sheets of PET into a cutting machine that has been provided with a suitably configured cutting die. Trays can be manufactured by using a suitable thermoforming or thermocasting technique to form desired tray compartments in a sheet of PET. A die cutting machine can then be used to cut the desired outer profile, including a resiliently deflectable locking tab.

It would also be possible to practice aspects of the invention using paperboard, cardboard, or like material, or a combination of such materials with plastic. It is noted, however, that paperboard or cardboard would typically lack the strength, durability, and resiliency of plastic. Thus, a package fabricated from those materials would be expected to have limited use.

Compliance with Regulatory Standards

As mentioned above, a child-resistant package must meet the requirements of applicable law. In the United States, in order to qualify under federal law as "child-resistant" and/or "senior-friendly," a package must be subjected to a rigorous testing process to verify that the package meets the standards set forth in regulations promulgated by the Consumer Product Safety Commission (CPSC), CFR Title 16, Part 1700 standards. A package according to the above-described practices of the invention has passed this testing process.

CONCLUSION

While the foregoing description includes details that will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. A package, comprising:

a tray and a sleeve, wherein the sleeve comprises a front panel and a back panel connected by a plurality of side panels so as to form an inner cavity with an insertion opening, wherein the tray is insertable into the insertion opening and is slidable within the inner cavity between a closed position and an open position, wherein the plurality of side panels includes a side panel having a rear locking slot, and wherein the tray includes an upper plate and a resilient, downwardly deflectable locking tab extending outwardly from the upper plate, wherein the locking tab and rear locking slot are shaped and positioned such that when the tray is seated in its closed position, the locking tab extends through the rear locking slot, perpendicular to the side panel having the rear locking slot, whereby contact between a contact edge of the locking tab and a corresponding contact edge of the rear locking slot prevents movement of the tray out of its closed position towards the insertion opening, wherein the locking tab and the rear locking slot are further shaped and positioned to form a press-down release structure such that the locking tab is downwardly deflectable to a position in which the contact edge of the locking tab is clear of the corresponding contact edge of the rear locking slot, thereby allowing the tray to be moved out of its closed position, wherein the sleeve is further provided with a resiliently deflectable release tab extending outwardly from the front panel, wherein the release tab is positioned such that, when the tray is in its closed position, the release tab overlies the locking tab, such that the locking tab is releasable from the rear locking slot by downward deflection of the release tab.

2. The package of claim 1, wherein the release tab comprises a free edge and two side edges connected to both ends of the free edge, and an end of the release tab away from the free edge is fixed to a sleeve panel.

3. The package of claim 2, wherein the side edges of the release tab extend into and connect to the front panel.

4. The package of claim 3, wherein a respective anti-tear portion is provided at an end of each of the side edges of the release tab connected to the sleeve panel.

5. The package of claim 4, wherein each anti-tear portion is a curved edge, and wherein two anti-tear portions extend along opposite directions.

6. The package of claim 1, wherein the locking tab includes a plurality of edges, comprising:

a locking edge extending outwardly from an edge of the tray, a transition edge connected to the locking edge and parallel to the edge of the tray, and a guiding edge connected to the transition edge and tilted to the edge of the tray, wherein the locking edge is configured to be engaged by the rear locking slot.

7. The package of claim 6, wherein the locking tab is shaped as a trapezoid having a right-angled leg and an oblique leg, wherein the locking edge is the right-angled leg of the trapezoid, and the guiding edge is the oblique leg of the trapezoid.

8. The package of claim 1, wherein the side panel having the rear locking slot is further provided with a front locking slot, wherein the front locking slot is positioned between the rear locking slot and the insertion opening.

9. The package of claim 8, wherein the sleeve is provided with an overhang that overlies the locking tab when the tray is seated in its open position.

10. The package of claim 8, wherein the trout locking slot and locking tab are shaped, such that when the tray is seated in its open position, the locking tab extends through the front locking slot, such that further movement of the tray out of the sleeve is prevented by contact between an edge of the locking tab and a corresponding edge of the front locking slot, and such that release of the locking tab by downward deflection is blocked by a portion of the side panel adjacent to the front locking slot.

11. The package of claim 10, wherein the front locking slot is shaped to have a lead region proximate to the insertion opening, a tail region distal from the insertion opening, and a transition region between the lead region and the tail region, wherein the tail region has a width that allows the locking tab to unfold through the front locking slot as the tray is pulled out of the sleeve, wherein the lead region has a width that is sufficiently narrow to prevent the locking tab from being downwardly deflected back through the front locking slot, and wherein the transition region is configured to provide a tapered transition between the width of the tail region and the width of the lead region.

12. The package of any one of claim 1, wherein the from panel includes a finger-receiving notch adjacent to the insertion opening, and wherein the tray is provided with a pulling plate corresponding to the finger-receiving notch, such that after the tray is inserted into the sleeve, the pulling plate, the back panel, and two side panels cooperatively form an accommodation space for accommodating a finger.

13. The package of claim 12, wherein the tray further comprises a protection sheet having a first end is rotatably attached to the tray and a second end that is foldable over the tray such that, when the tray is inserted into the sleeve, the protection sheet extends into the inner cavity and abuts against an inner surface of the front panel.

* * * * *